US005103747A

United States Patent [19]

Resta et al.

[11] Patent Number: 5,103,747

[45] Date of Patent: Apr. 14, 1992

[54] QUILTING MACHINE WITH STATIONARY CLOTH-HOLDER FRAME AND SEWING HEADS MOVABLE IN ORTHOGONAL DIRECTIONS

[75] Inventors: Mario Resta; Roberto Resta; Rodolfo Resta, all of Faenza, Italy

[73] Assignee: Resta Commerciale S.r.l., Faenza, Italy

[21] Appl. No.: 507,556

[22] Filed: Apr. 11, 1990

[30] Foreign Application Priority Data

Apr. 21, 1989 [IT] Italy ..... 3438 A/89

[51] Int. Cl.[5] ..... D05B 11/00

[52] U.S. Cl. ..... 112/117; 112/121.14

[58] Field of Search ..... 112/117, 118, 119, 121.14, 112/121.12, 121.11, 121.15, 2

[56] References Cited

U.S. PATENT DOCUMENTS 4,601,249 7/1986 Frye ..... 112/121.14
4,669,405 6/1987 Resta et al. ..... 112/119 X
4,969,410 11/1990 Brower et al. ..... 112/117 X

FOREIGN PATENT DOCUMENTS 61-48395 3/1986 Japan ..... 112/121.14

*Primary Examiner*—Peter Nerbun
*Attorney, Agent, or Firm*—Guido Modiano; Albert Josif

[57] ABSTRACT

The quilting machine comprises a supporting frame with vertical uprights which support, at the top, two horizontal parallel guides. A truck which bears at least one sewing device is slidably suspended on the guides. The truck is composed of two side plates connected to one another by two beams which extend above and respectively below the plane of the cloth-holder frame and act as guide for a sewing head and respectively for a complementary hook device of said at least one sewing device.

2 Claims, 1 Drawing Sheet

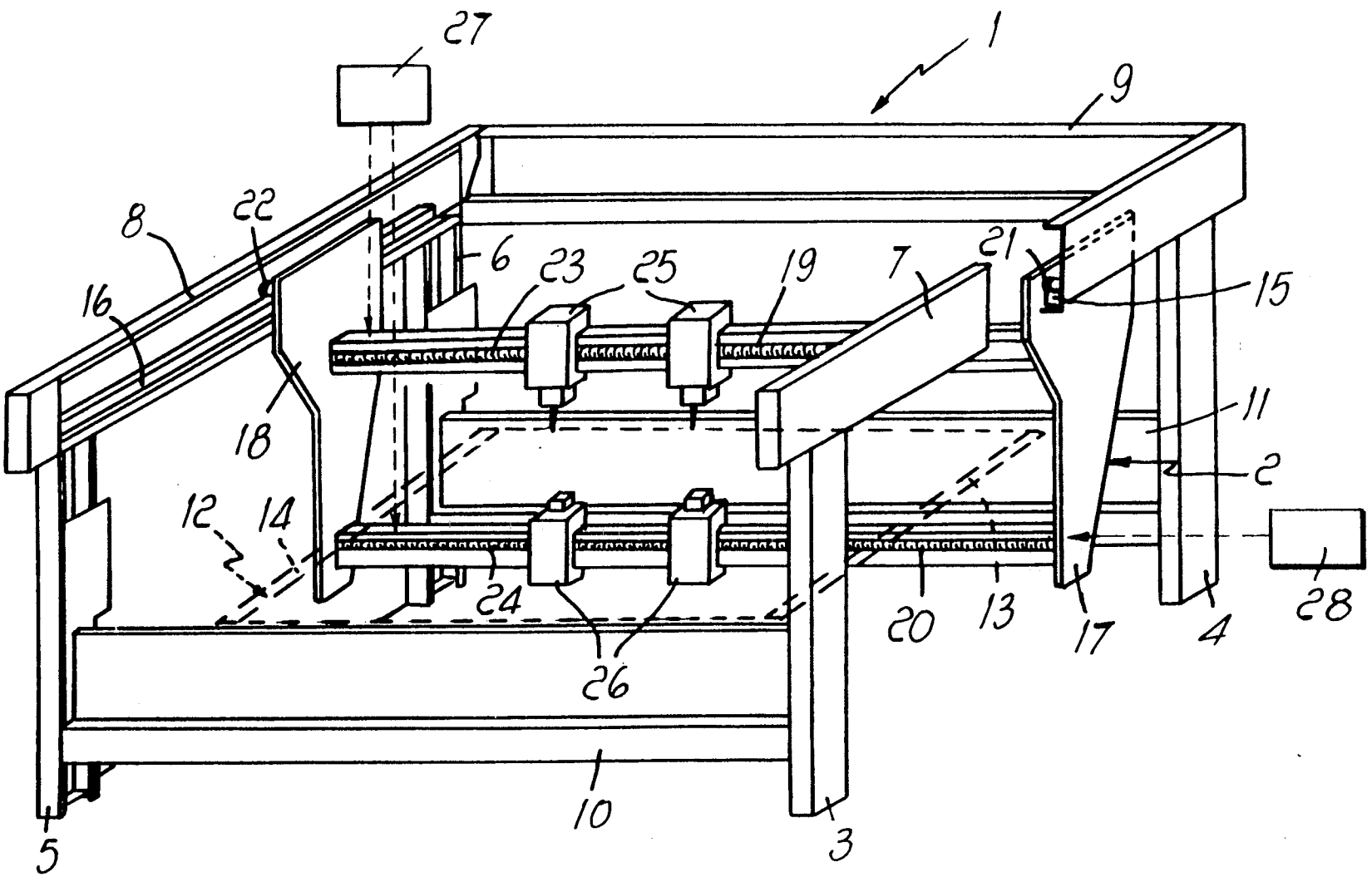
1
2
3
4
5
6
7
8
9
10
11
12
13
14
15
16
17
18
19
20
21
22
23
24
25
26
27
28

QUILTING MACHINE WITH STATIONARY CLOTH-HOLDER FRAME AND SEWING HEADS MOVABLE IN ORTHOGONAL DIRECTIONS

BACKGROUND OF THE INVENTION

The present invention relates to a quilting machine with a stationary cloth-holder frame and sewing heads movable in orthogonal directions.

A known-type quilting machine is generally constituted by a cloth-holder frame mounted on a first truck which slides on a second truck in a linear manner. Said second truck slides, again in a linear manner but in a direction which is orthogonal to that of the first truck, on guides which rest on the floor.

The trucks are actuated so as to move below a fixed sewing head according to a path set by a template or another control system.

Another kind of quilting machine operates exactly in reverse, i.e. the sewing head moves along orthogonal axes on a stationary truck on which the cloth to be quilted is fixed.

The severe disadvantage peculiar to known quilting machines consists in the fact that they are all difficult and laborious to install, in particular as regards the installation of the guides on the floor, which requires exact levelling.

User access to the cloth-holder frame is furthermore extremely troublesome due to the guides which rest on the floor and hinder the users when they approach the cloth-holder frame to check the sewing operations, to engage a new cloth or when manual operations must be performed on the frame to adapt it to other sizes.

SUMMARY OF THE INVENTION

The technical aim of the present invention is to provide a quilting machine which is structured so as to obviate the above described disadvantages of conventional machines.

This aim is achieved by a quilting machine as defined in the appended claims.

BRIEF DESCRIPTION OF THE DRAWINGS

The advantages and features of the invention will become apparent from the following detailed description of a preferred embodiment, illustrated only by way of non-limitative example in the accompanying drawing, the only FIGURE whereof is a partially schematic perspective view of a quilting machine according to the invention.

DESCRIPTION OF THE PREFERRED EMBODIMENTS

With reference to the above FIGURE, 1 generally indicates the supporting frame for a truck 2 which supports sewing devices.

The supporting frame 1 is composed of four vertical uprights 3, 4, 5 and 6 which are arranged substantially at the corners of a rectangle.

The uprights 3, 4 are mutually connected, at the top, by a horizontal slide member 7, and an identical horizontal side member 8 connects the tops of the uprights 5 and 6 and extends parallel to the side member 7.

The four uprights 3–6 and the two slide members 7–8 comprise profiled elements with a inwardly open U-shaped cross section.

The side members 7, 8 are connected, at one end thereof, by a box-like beam 9, and two further transverse beams 10 and 11 mutually connect the uprights 3, 4 with the opposite uprights 5 and 6 at a lower portion thereof. The beams 10 and 11 have a box-like cross section in the shape of an inverted T and support a cloth-holder frame generally indicated at 12 and shown in broken lines. Said frame is of the conventional kind and comprises two longitudinal sides 13, 14 provided with means for coupling the lateral edges of the cloth to be quilted. Preferably one side of the frame, for example the side 13, is fixed, and the other side 14 has an adjustable distance with respect to the fixed side so as to allow the dimensions of the frame to be adapted to the cloth to be quilted.

Two respective sliding guides 15, 16 for the truck 2 are rigidly associated with the inner faces of the side members 7,8.

The truck 2 comprises two side plates 17, 18 rigidly connected to one another by means of a pair of parallel beams 19, 20 which extend above and respectively below the plane of the frame 12.

Rollers 21, 22 are mounted at the top of the side plates 17, 18, protrude outward and have a rolling coupling to the guides 15, 16.

The beams 19 and 20 constitute sliding guides for sewing devices controlled by threaded rods 23, 24 and actuated in both directions so as to perform sewing lines on the cloth stretched on the frame.

Two sewing devices are provided in the illustrated example; their heads 25 for moving the needle are supported on the upper beam 19, whereas the underlying "crochet" or hook devices 26, which together with the heads 25 perform the sewing are supported on the lower beam 20.

The movement of the sewing devices with respect to the cloth occurs in two orthogonal directions by means of two motor units 27,28, one 27 of which causes rotation of the threaded rods 23,24 and thus the movement of the sewing devices in a transverse direction along the beams 19 and 20, while the other one 28 causes the movement of the truck 2 along the guides 15 and 16 in a longitudinal direction.

As can be seen, the quilting machine perfectly achieves the intended aim. It in fact rests on the ground only at the four uprights and can be easily levelled without having to level the floor and therefore in a simple and rapid manner.

The upward transfer of the truck sliding guides furthermore allows to keep clear the area adjacent to the cloth-holder frame, facilitating the access of the operators in the work area in order to perform interventions, inspections and the necessary verifications.

We claim:

1. A quilting machine comprising:

a supporting frame including four vertical uprights having top ends and two horizontal parallel side members connecting the top ends of said uprights in pairs;

a stationary cloth-holder frame fixed to said supporting frame;

a pair of parallel and horizontal truck guides, each guide being fixed to a respective side member;

a truck defining two side elements carrying rollers at their upper ends, said rollers protruding therefrom and engaging said truck guides for slidingly supporting said truck on said truck guides, and a pair of horizontal and parallel beams connecting said side elements, one of said beams extending above said cloth-holder frame, another one of said beams extending below said cloth-holder frame, said beams forming sliding guides for a sewing head and respectively for a complementary hook device of at least one sewing device.

2. A machine according to claim 1, wherein said side members are connected, at one end, by a further beam.

* * * * *